US005326154A

United States Patent [19]

Williamson et al.

[11] Patent Number: 5,326,154

[45] Date of Patent: Jul. 5, 1994

[54] SINGLE-POST, HEIGHT-ADJUSTABLE AND REMOVABLE ARMREST APPARATUS FOR A WHEELCHAIR

[75] Inventors: Daniel E. Williamson; Gordon Stout, both of Fresno, Calif.

[73] Assignee: Quickie Designs Inc., Fresno, Calif.

[21] Appl. No.: 977,573

[22] Filed: Nov. 17, 1992

[51] Int. Cl.[5] ..... A47C 7/54

[52] U.S. Cl. ..... 297/411.36; 297/115; 297/DIG. 4; 297/411.27

[58] Field of Search ..... 292/213, 218; 297/411.45, 411.26, 411.27, 411.31, 411.35, 411.36, DIG. 4, 440.1, 440.24, 115

[56] References Cited

U.S. PATENT DOCUMENTS

| | | | |
|---|---|---|---|
| 3,124,328 | 3/1964 | Kortsch | 297/411.36 |
| 3,489,458 | 1/1970 | Karlsen | 297/411.45 |
| 3,950,027 | 4/1976 | Wilson | 297/411.27 |
| 4,244,623 | 1/1981 | Hall | 292/411.36 |
| 4,311,338 | 1/1982 | Moorhouse | 297/411.36 |
| 4,913,393 | 4/1990 | Wood | 297/411.31 |
| 4,968,094 | 11/1990 | Froyland | 297/411.36 |
| 5,064,228 | 11/1991 | Bisbing | 292/218 |

FOREIGN PATENT DOCUMENTS

| | | | |
|---|---|---|---|
| 0802663 | 12/1968 | Canada | 297/DIG. 4 |

*Primary Examiner*—P. Austin Bradley
*Assistant Examiner*—James Miner
*Attorney, Agent, or Firm*—Flehr, Hohbach, Test, Albritton & Herbert

[57] ABSTRACT

A single-post, height-adjustable and removable armrest apparatus (30) for a wheelchair having wheelchair frame (21). The armrest apparatus includes a base (31) formed for mounting to the wheelchair frame and an arm support assembly (32) having a height-adjustable armrest post (33). Interdisposed between the base and the support assembly is an elongated mounting assembly (34). A locking mechanism (37) is movably mounted to a mounting end (35) of the mounting assembly between a locked condition and a unlocked condition. In the locked condition, the mounting end is locked to the base member, while in the unlocked condition, the mounting end is released from the base. A securing mechanism (40) is movably mounted to an engaging end (36) of the mounting assembly between a secured condition and an unsecured condition. In the secured condition, the armrest post is locked to the mounting assembly, while in the unsecured condition, height adjusting movement of the armrest post is permitted relative to the engaging end. The armrest apparatus further includes a manually engageable latch assembly (41) operably engaging both the locking mechanism and the securing mechanism. The latch assembly moves between a selected one of: 1) the locking mechanism to move the locking mechanism from the locked condition to the unlocked condition, while the securing mechanism is retained in the secured condition; and 2) the securing mechanism to move the securing mechanism from the secured condition to the unsecured condition, while the locking mechanism is retained in the locked condition.

49 Claims, 6 Drawing Sheets

SINGLE-POST, HEIGHT-ADJUSTABLE AND REMOVABLE ARMREST APPARATUS FOR A WHEELCHAIR

TECHNICAL FIELD

The present invention relates, generally, to armrest apparatus for wheelchair and, more particularly, single-post, height-adjustable and removable armrest apparatus.

BACKGROUND ART

Wheelchairs generally include a seat assembly mounted to a wheelchair frame and two armrest apparatuses positioned adjacent to and on opposing sides of the seat. These armrest apparatuses generally provide the occupant support during ingress and egress from the wheelchair. Just as importantly, though, armrests provide comfort and convenience for the occupant by furnishing a fixture upon which they may rest their arms. Hence, the prior art armrests, as shown in FIG. 1, are often height-adjustable and/or removable from the wheelchair to accommodate a variety of different sized and shaped persons.

Typically, height-adjustable armrest apparatuses 10 include an armrest base frame 11 rigidly secured to a portion of a wheelchair frame 12 adjacent a seat (not shown). Armrest apparatus 10 usually includes an armrest pad 14 which is carried by an inverted, U-shaped, pad support frame 13. This support frame 13 includes a horizontal tube portion 15, supporting the pad, and a pair of vertical posts 16 extending downwardly from opposite ends of the horizontal tube portion. Each post 16 is oriented in a substantially vertical manner for ease of mounting and height adjustment relative to armrest base frame 11.

Base frame 11 usually includes a pair of spaced-apart upwardly extending receiving tubes 17 each having post receiving bores 18 dimensioned to slidably and telescopically receive the distal ends of the corresponding post portions. Hence, the height of armrest pad 14 can be adjusted by moving posts 16 reciprocally in or out of the corresponding receiving bores 18. A releasable locking latch 19 is usually provided to lock support frame relative to base frame 11 after height adjustment has been made.

While these two-post height-adjustable armrest apparatuses 10 provide added lateral mounting stability, several problems are inherent with these designs. For example, these armrest apparatuses are difficult for quadriplegics (i.e., those severely impaired) to manipulate. While attempting to adjust the height of pad support frame 13, those with limited physical capabilities are often unable to telescopically retract or extend both posts 16 simultaneously into or out of the corresponding receiving bores 18 in a smooth even manner. Hence, this skewed motion causes posts 16 to lodge or jam in the corresponding receiving bores 18.

Moreover, once the occupant applies a force sufficient to dislodge the posts from their skewed orientation relative the receiving bores, the momentum often completely separates the pad support frame from the base frame. Thus, the occupant is burdened with the prospect of reinstalling the posts back into the corresponding bores. This task is troublesome since the occupant may experience alignment difficulties between the posts and the corresponding receiving bores, particularly if support frame 13 should be dropped during handling. Should this occur, substantial bending may be required in order to reinstall the armrest. This problem can be magnified for those users who are severely physically impaired.

Another problem associated with prior two-post armrest apparatuses is that they do not facilitate interchangeability of the armrests. Sometimes, the user may find it desirable to increase or decrease the length of the armrest support frame. With the current two-post armrest apparatuses once base frame 11 is mounted to wheelchair frame 12, only those armrests support frames having post ends properly corresponding to the distance between the post receiving bores of the receiving tubes may be installed.

Single-post height-adjustable armrest apparatuses (not shown) have been developed to overcome the above-mentioned problems associated with the two-post assemblies. Typically, the single post is telescopically received in a receiving bore which, in combination, functions both as a height adjustment mechanism as well as an armrest assembly mounting mechanism. Hence, when the tolerances between the post and the bore are too small, the pad support frame often becomes lodged in the receiving bore. Accordingly, similar to the two-post assemblies, when the occupant attempts dislodge the post, they often inadvertently remove the post completely out of the receiving bore. In contrast, when the tolerances are too large (i.e., to reduce jamming therebetween), the post tends to rattle and move about the receiving bore causing the pad support frame to feel unstable.

DISCLOSURE OF INVENTION

Accordingly, it is an object of the present invention to provide a single-post, height-adjustable and removable armrest apparatus for a wheelchair which can be easily manipulated by quadriplegics.

It is another object of the present invention to provide an armrest apparatus which facilitates adjustment of the armrest pad height, and eases installation and removal of the armrest assembly from a wheelchair.

Still another object of the present invention is to provide an armrest apparatus which promotes interchangeability between the armrests.

Yet another object of the present invention is to provide a single-post, height-adjustable and removable armrest apparatus for a wheelchair with the mounting stability of a two-post armrest apparatus.

It is a further object of the present invention to provide a single-post, height-adjustable and removable armrest apparatus which is durable, compact, easy to maintain, has a minimum number of components, is easy to use by unskilled personnel, and is economical to manufacture.

The present invention includes a single-post, height-adjustable and removable armrest apparatus for a wheelchair having wheelchair frame. The armrest apparatus includes a base formed for mounting to the wheelchair frame and an arm support assembly having a height-adjustable armrest post. Interdisposed between the base and the support assembly is an elongated mounting assembly which includes a mounting end and an opposite armrest post engaging end. A locking mechanism is mounted for movement to one of the mounting end of the mounting assembly and the base between a locked condition and a unlocked condition. In the locked condition, the mounting end is locked to the base member, while in the unlocked condition, the mounting end is released from the base. A securing mechanism is also provided and mounted for movement to one of the armrest post and the engaging end of the mounting assembly between a secured condition and an unsecured condition. In the secured condition, the armrest post is locked to the mounting assembly, while in the unsecured condition, height adjusting movement of the armrest post is permitted relative to the engaging end. The armrest apparatus further includes a manually engageable latch assembly formed and mounted to engage both the locking mechanism and the securing mechanism. The latch assembly is formed for movement of a selected one of: 1) the locking mechanism to move the locking mechanism from the locked condition to the unlocked condition, while the securing mechanism is retained in the secured condition; and 2) the securing mechanism to move the securing mechanism from the secured condition to the unsecured condition, while the locking mechanism is retained in the locked condition.

In another aspect of the present invention, the base is formed with a mounting cavity formed and dimensioned for sliding receipt of the mounting end of mounting assembly. Further, the armrest post includes a post surface extending longitudinally along one side thereof, and the mounting assembly includes a longitudinally extending receiving channel dimensioned to loosely receive the post therein. A channel lining is positioned in the receiving channel and aligned in an orientation to resiliently and slidably contact the post surface when the armrest post is received in the receiving channel. A lining adjustment mechanism is provided which urges the channel lining toward the post surface to produce snug sliding engagement between the post surface and the channel lining.

Accordingly, the present invention provides a single-post, height-adjustable and removable armrest apparatus for a wheelchair. The latch assembly permits the wheelchair occupant to adjust the height of the armrest support assembly without inadvertently removing the support assembly from the wheelchair frame. Similarly, the occupant may remove the mounting assembly and the armrest support assembly, as a unit, from the wheelchair frame without upsetting the previously adjusted height of the armrest support assembly.

BRIEF DESCRIPTION OF THE DRAWING

The assembly of the present invention has other objects and features of advantage which will be more readily apparent from the following description of the Best Mode of Carrying Out the Invention and the appended claims, when taken in conjunction with the accompanying drawing, in which:

BEST MODE OF CARRYING OUT THE INVENTION

Figure 1:
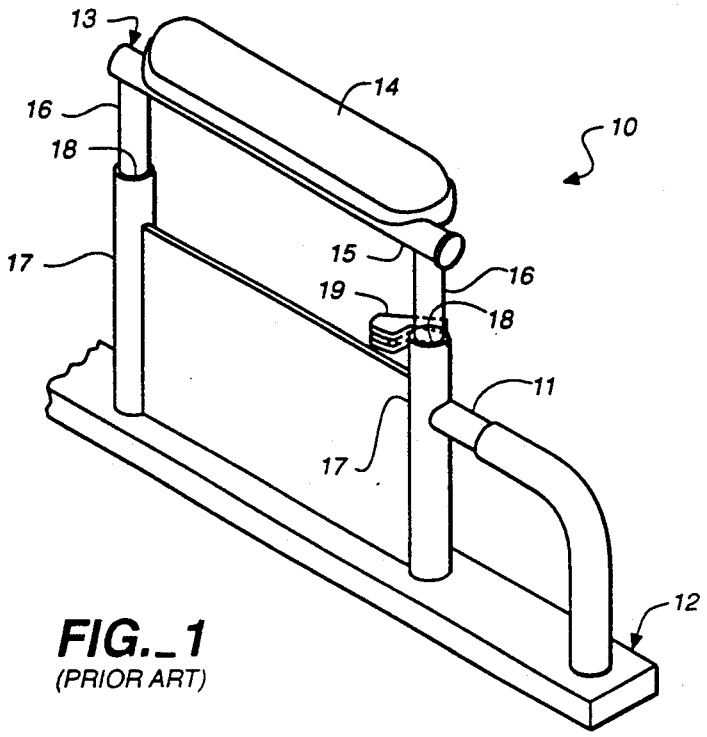
FIG. 1 (PRIOR ART)
FIG. 1 is a top perspective view of a prior art two-post, height-adjustable and removable armrest apparatus mounted to a wheelchair frame assembly.

The following description is presented to enable a person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein. It will be noted here that for a better understanding, like components are designated by like reference numerals throughout the various figures.

Figure 2:
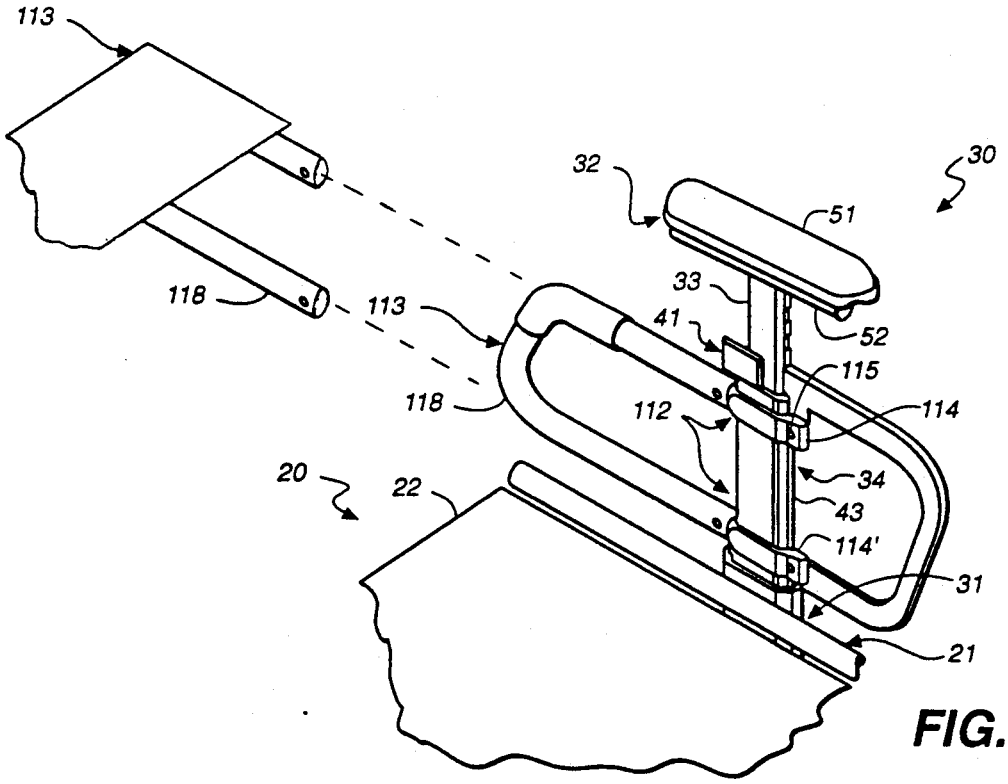
FIG. 2 is a top perspective view of a single-post, height-adjustable and removable armrest apparatus constructed in accordance with the present invention and mounted to a wheelchair frame assembly.
Figure 3:
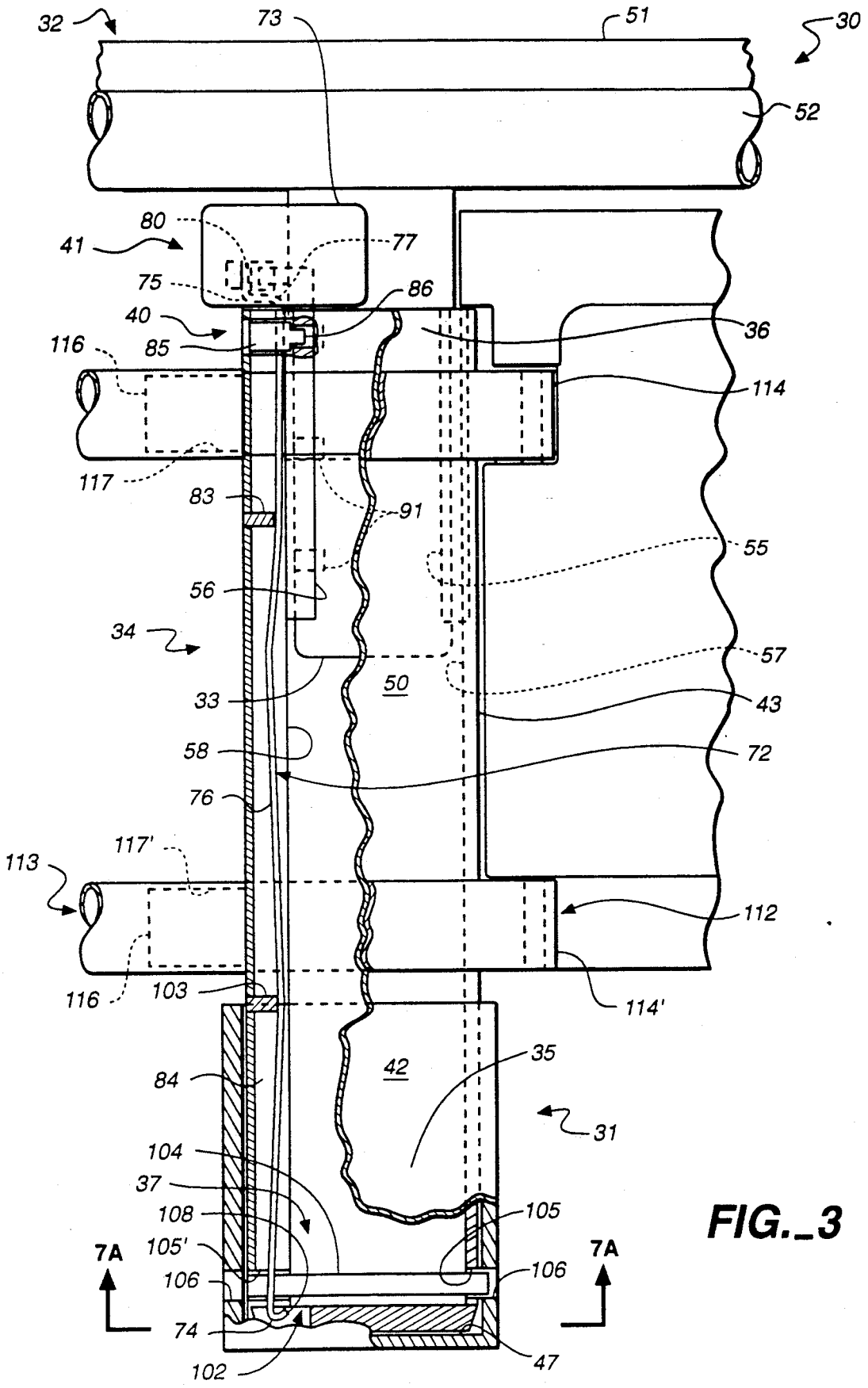
FIG. 3 is an enlarged, fragmentary front elevation view, partially broken away, of the single-post armrest apparatus of FIG. 2.
Figure 5A:
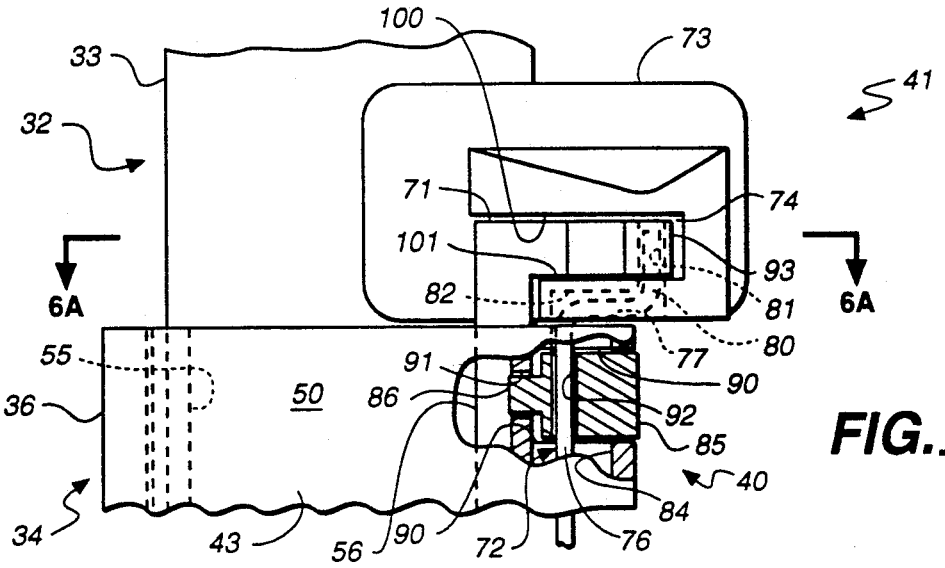
FIGS. 5A-5C are a series of enlarged, fragmentary, rear elevation views, partially broken away, illustrating the three positions of a latch assembly of the present invention and the corresponding positions of a securing mechanism retaining pin.
Figure 7A:
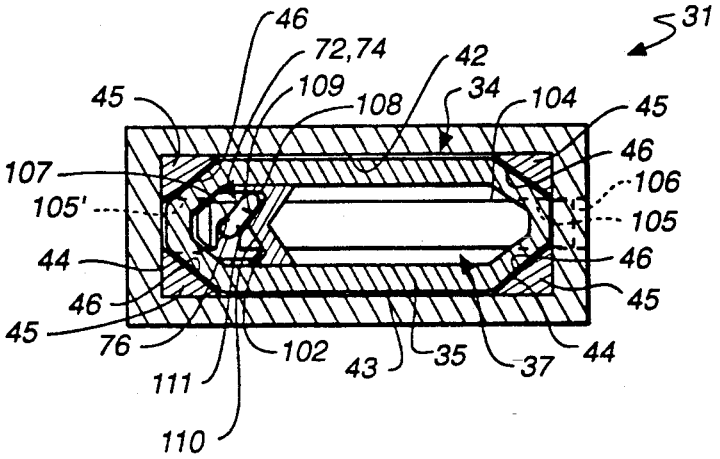
FIGS. 7A-7C are a series of enlarged bottom plan views of the three positions of a locking mechanism retaining pin corresponding to the three positions of the latch assembly of the corresponding FIGS. 5A-5C, and taken substantially along the plane 7—7 in FIG. 3.
Figure 7B:
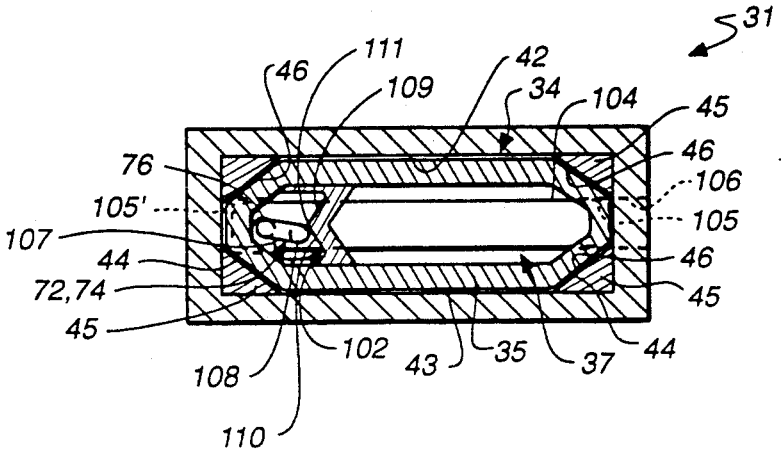

Attention is now directed to FIGS. 2 and 3, where the subject single-post, height-adjustable and removable armrest apparatus, generally designated 30, for a manual wheelchair 20 is illustrated. Briefly, wheelchair 20 includes a wheelchair frame 21 which carries and supports a seat 22 thereon. The present invention includes a base member, generally designated 31, which is formed for mounting to wheelchair frame 21, and an arm support assembly, generally designated 32, having a height-adjustable armrest post 33. An elongated mounting assembly 34 is interdisposed between base 31 and support assembly 32, and includes a mounting end 35 and an opposite armrest post engaging end 36. Locking means, generally designated 37, is provided and mounted for movement to one of the mounting end 35 of mounting assembly 34 and base member 31 between a locked condition (FIGS. 7A and 7C) and an unlocked condition (FIG. 7B). In the locked condition, mounting end 35 is releasably locked to base member 31, while in the unlocked condition, mounting end 35 is released from base 31. Securing means, generally designated 40, is also provided and mounted for movement to one of armrest post 33 and engaging end 36 of mounting assembly 34 between a secured condition (FIGS. 5A and 5B) and an unsecured condition (FIG. 5C). In the secured condition, armrest post 33 is releasably secured to mounting assembly 34, while in the unsecured condition, height adjusting movement of armrest post 33 may be performed relative to engaging end 36. Armrest apparatus 30 further includes a manually engageable latch assembly, generally designated 41, formed and mounted to engage both locking means 37 and securing means 40. Through manual movement of latch assembly 41, the wheelchair occupant may selectively move one of: 1) the locking means from the locked condition to the unlocked condition, while retaining the securing means in the secured condition; and 2) the securing means from the secured condition to the unsecured condition, while retaining the locking means in the locked condition.

Accordingly, unlike the prior art adjustable-height armrest apparatus, the present invention simplifies operation thereof by providing a single latch assembly which engages locking means 37 when securing means 40 is released. This permits adjustment of the height of armrest support assembly 32 by the wheelchair occupant without inadvertently separating or removing the whole support assembly 32 from wheelchair frame 21. Similarly, the latch assembly engages securing means 40 when locking means 37 is disengaged which permits removal of mounting assembly 34 and armrest support assembly 32, as a unit, from the wheelchair frame without disturbing the previously adjusted height of armrest support assembly 32.

Figure 7C:
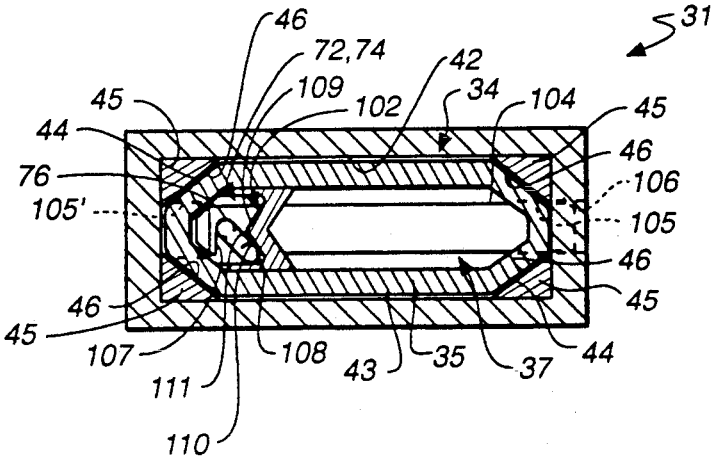

In the preferred embodiment, base member 31 provides a mounting cavity 42 formed and dimensioned for sliding receipt of the mounting end of mounting assembly 34. Briefly, mounting assembly 34 includes a mounting post 43 which provides mounting end 35 on one end and armrest engaging end 36 on an opposite end thereof. FIGS. 7A–7C illustrate that the peripheral, cross-sectional, transverse dimension of mounting end 35 of mounting post 43 is basically rectangular having chamfered corner portions 44 which extend longitudinally along the mounting end to, but not necessarily, the armrest engaging end 36. Thus, to provide lateral mounting support to the mounting assembly, receiving cavity 42 is also substantially rectangular and loosely conforms to the periphery of mounting end 35.

The base member preferably includes cavity linings 45 positioned at the four corners of cavity 42. The cavity linings are formed with vertical planar contact faces 46 which, upon receipt of the mounting end in cavity 42, slidably engage the exterior surfaces of the mounting post chamfers 44. Cavity linings 45 are preferably plastic or the like so that contact faces 46 are a laterally supportive, yet sufficiently resilient, to releasably grip the chamfers for substantially snug contact. Receiving cavity 42 and cavity linings 45, therefore, cooperate to substantially conform to the above-mentioned peripheral dimension of mounting end 35. Thus, the interengaged sliding receipt of mounting end 35 in base member 31 provides substantial lateral stability to mounting assembly 34. It will be understood, however, that cavity linings 45 do not grip chamfers 44 in a manner too tight where the physically impaired occupant would have difficulty slidably separating (when latch assembly 41 is properly positioned) the mounting end from the receiving cavity.

As viewed in FIG. 2, the base member may be removably mounted to a portion of wheelchair frame 21 adjacent seat assembly 22 by mounting brackets, fasteners (both not shown) or the like. A stopping lip 47 (FIG. 3) is provided proximate a lower portion of cavity 42 which limits the extension of the mounting end into cavity 42. Hence, locking means 37, as will be described in greater detail below, can be more easily aligned for locking engagement.

Referring back to FIGS. 3 and 4, mounting post of mounting assembly 34 preferably provides a longitudinally extending receiving channel, generally designated 50, at the armrest engaging distal end which is dimensioned to slidably receive armrest post 33 therein. Briefly, armrest support assembly 32 includes an armrest pad 51 mounted to a pad support beam 52 formed to carry pad 51 thereon. Support beam 52 is mounted transversely to the upper distal end of elongated armrest post 33. FIGS. 2 and 3 illustrate that armrest post 33 telescopically and slidably reciprocates in channel 50 for height-adjustable extension or retraction of armrest support assembly 32 relative mounting assembly 34.

Similar to mounting post 43 of mounting assembly 34, FIGS. 4 and 6A–6C illustrate that the peripheral, cross-sectional, transverse dimension of armrest post 33 is basically rectangular having first chamfered corner portions 53, 53' on one longitudinal side on first post surfaces thereof. On an opposite longitudinal side or second post surface of armrest post 33, second chamfered corner portions 54, 54' are provided. Thus, to provide lateral mounting support to the armrest support assembly, receiving channel 50 is also substantially rectangular or oblong and loosely conforms to the periphery of armrest post 33. Incidently, armrest post 33 is preferably symmetrical, with respect to the transverse dimension, such that first chamfers 53, 53' and second chamfers 54, 54' are substantially identical, and thus, may be interchangeably received.

Mounting assembly 34 further includes a first channel lining 55 extending along and against an inner side wall 57 of an upper portion of receiving channel 50. As best viewed in FIGS. 6A–6C, first channel lining 55 is formed to slidably engage first chamfers 53, 53' (first post surface) of armrest post 33. A second channel lining 56 is provided extending along and against an opposite inner side wall 58 of the upper portion of receiving channel 50. Second channel lining 56 is also formed to slidably engage second chamfers 54, 54' (second post surface) of armrest post 33. Similar to cavity linings 45, first and second channel linings 55, 56, respectfully, are preferably plastic or the like so that engaging faces 60, 61, respectively, thereof are laterally supportive, yet sufficiently resilient, to releasably grip the corresponding chamfers of the armrest post for substantially snug sliding engagement. Therefore, the receiving channel and the channel linings cooperate to substantially conform (as will be described below) to the peripheral dimension of armrest post 33 so that interengaged sliding receipt of the distal end of armrest post 33 in armrest engaging end 36 of mounting post 43 provides substantial lateral stability to armrest support assembly 32. Again, it will be understood, however, that the channel linings do not grip the armrest post chamfers in a manner too tight where the wheelchair occupant would have difficulty slidably height adjusting the armrest post (when latch assembly 41 is properly positioned) relative receiving channel 50.

Figure 4:
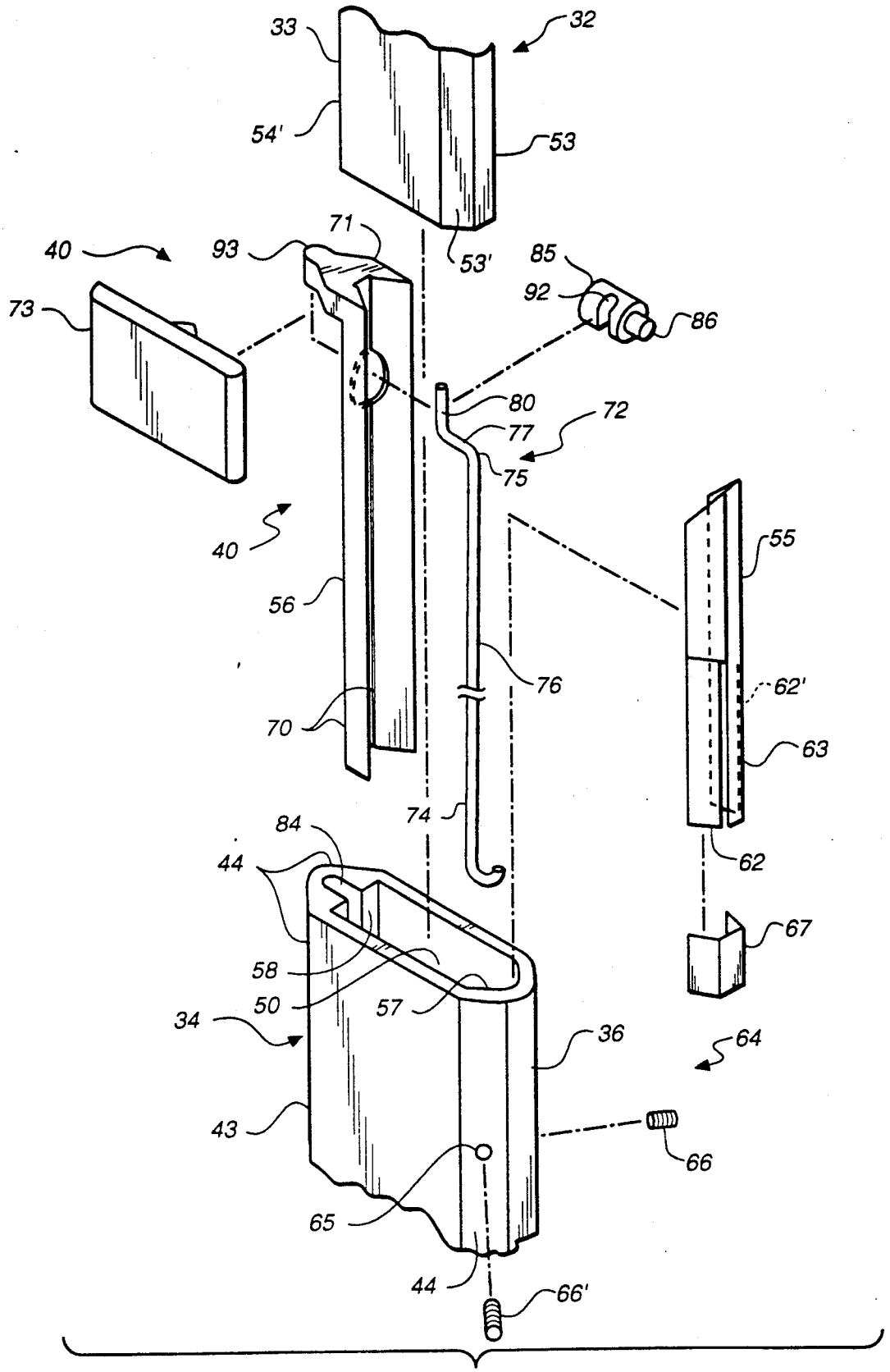
FIG. 4 is an enlarged, exploded top perspective view of a mounting assembly of the height-adjustable and removable armrest apparatus of FIG. 2.

As viewed in FIGS. 4 and 6A–6C, first channel lining 55 is elongated and V-shaped to substantially conform to the angular inclination between first chamfers 53, 53'. Further, the V-shape permits the backside of the channel lining to be wedged against inner side wall 57 and fastened thereto by a fastener (not shown). FIG. 4 illustrates that three independent finger portions (outer fingers 62, 62' and middle finger 63) extend downwardly from a midportion of first lining 55. Outer fingers 62 and 62' include engaging surfaces 60, 60' (FIGS. 6A–6C) which slidably engage first chamfers 53, 53', respectively, of armrest post 33.

In accordance with the present invention, to assure and maintain a proper tolerance between the channel linings and the corresponding chamfer surfaces as the components wear, mounting assembly 34 provides channel lining adjustment means 64 (FIGS. 4 and 6A–6C) which adjustably urge first channel lining 55 toward the first post surfaces or corresponding first chamfers 53, 53' to produce snug sliding engagement therebetween. Adjustment means 64 allows the wheelchair occupant to manually adjust the frictional sliding engagement of the armrest post chamfers with the first channel linings to a degree where height adjustments to the armrest support assembly may be readily performed while instability between the components is substantially reduced.

In the preferred form, adjustment means 64 includes threaded adjustment apertures 65, 65', proximate the armrest engaging end 36, which extend through the exterior surface of mounting post chamfers 44 into receiving channel 50. Apertures 65, 65' are formed and dimensioned to threadably receive corresponding adjustment screws 66, 66' which adjustably abut the backside of outer finger portions 62, 62' (FIGS. 6A-6C) in a manner causing them to independently extend toward an interior portion of receiving channel 50. Thus, lining adjustment means 64 can be manually adjusted to increase or decrease (by turning screws 66, 66') the frictional sliding engagement between first fingers 62, 62' and first armrest post chamfers 54, 54'.

As best viewed in FIG. 4, lining adjustment means 64 preferably includes a resilient liner spring 67 disposed and interweaved between middle finger 63 and outer fingers 62, 62'. Liner spring 67 further urges outer fingers 62, 62' into sliding contact with first chamfers 53, 53' to provide a resilient contact therebetween. In addition, liner spring 67 is aligned and positioned so that adjustment screws 66, 66' directly contact the more .rigid backside of liner spring 67 rather than the softer backside of outer fingers 62, 62'.

Second channel lining 56, as shown in FIG. 4, also includes two independent finger portions 70, 70' extending downwardly from a lever engaging member 71 (FIG. 4). Briefly, engaging member 71 forms a portion of latch assembly 41 which will be described in greater detail below. Second lining finger portions 70, 70' are formed with substantially vertical planar engaging faces 61, 61' which, upon receipt of the distal end of the armrest post in channel 50, slidably engage the exterior surfaces of second chamfer portions 54, 54' (second post surfaces). Thus, receiving channel 50, first and second channel liners 55, 56, and channel lining adjustment means 64 all cooperate to receive armrest post 33 for snug sliding engagement between the first chamfers 53, 53' and outer finger portions 62, 62' and between second chamfers 54, 54' and second finger portions 70, 70'.

Accordingly, because of the lateral stability provided between base member 31 and the mounting end of mounting post 43, and between the armrest engaging end 36 of mounting post 43 and armrest post 33, the wheelchair occupant may confidently rely on the armrest support assembly to provide stable support without experiencing significant wobble during use. Moreover, the present invention provides the convenience of the single-post approach while substantially eliminating the tolerance problems of the prior art single-post adjustable assembles (i.e., substantial instability and rattling between the telescopic components).

In accordance with the present invention, manually engageable latch assembly 41, as shown in FIGS. 4-7C, includes spring means 72 operably engageable with both locking means 37 and securing means 40. In the preferred embodiment, latch assembly 41 is manually movable between a selected one of: a retaining position (FIGS. 5A and 6A); a mounting assembly releasing position (FIGS. 5B and 6B); and an armrest height adjusting position (FIGS. 5C and 6C). When latch assembly 41 is manually moved to the retaining position, spring means 72 urges locking means 37 toward the locked condition (FIG. 7A) and securing means 40 toward the secured condition (FIGS. 5A and 6A). When latch assembly 41 is manually moved to the mounting assembly releasing position, spring means 72 urges locking means 37 toward the unlocked condition (FIG. 7B) and securing means 40 toward the secured condition (FIGS. 5B and 6B). Finally, when latch assembly 41 is manually moved to the armrest height adjusting position, spring means 72 urges locking means 37 toward the locked condition (FIG. 7C) and securing means 40 toward the unsecured condition (FIGS. 5B and 6B).

Briefly, to retain latch assembly 41 in the above-mentioned latch positions, latch assembly 41 includes a manually movable lever member 73 and a stable lever engaging member 71 which cooperate, together with torsion spring 72, to hold the lever in a stable interengaged condition in each of the latch positions. It will be understood and as previously mentioned, second finger portions 70, 70' of second channel lining 56 are integral with and extend downwardly from lever engaging member 71 (FIGS. 4 and 5A-5C). Hence, when second channel lining 56 is securely mounted to opposite inner side wall 58 of receiving channel 50, lever engaging member 71 is rigidly mounted to mounting assembly 34.

As best viewed in FIGS. 3 and 4, spring means 72 is provided by an elongated metallic torsion spring 72 having a cam engaging end 74 and an opposite latch engaging end 75. Spring 72 includes an intermediate resilient leg portion 76 which extends longitudinally along mounting post 43 proximate receiving channel 50 and is in communicating movement with locking means 37 and securing means 40 through lateral displacement and rotational motion about a longitudinal axis thereof. Through latch engaging end 75, rotation and lateral displacement of torsion spring 72 is provided by manual movement of lever member 73 between the retaining position, the releasing position and the height adjusting position. The engaging end includes an arm portion 77 extending substantially perpendicularly from an upper distal end of leg portion 76 in a direction toward the lever member. Further, extending perpendicularly upward from arm portion 77 is a spring finger portion 80 which is securely received in a finger slot 81 provided in lever member 73. Arm portion 77, which supports and carries lever member 73 relative to lever engaging member 71, preferably is seated in an arm receiving groove 82 provided at a bottom portion of the lever member. Accordingly, arm portion 77 cooperates with receiving groove 82 such that the arm portion does not move relative to lever member 73. Manual movement of the lever member about the lever engaging member, therefore, causes leg portion 76 to rotate and laterally displace about its longitudinal axis.

To maintain lever member 73 continuously and resiliently against engaging member 71 for stable interengagement, mounting assembly 34 includes a securing fulcrum 83 which contacts an upper intermediate portion of leg 76 of torsion spring 72 between opposed ends thereof. As viewed in FIG. 3, securing fulcrum 83 transversely loads the resilient leg portion in a manner causing lever member 73 to continuously and resiliently contact lever engaging member 71. Accordingly, leg portion 76, in addition to rotational motion, can be laterally displaced or cantilevered about securing fulcrum 83 when lever member 73 is manually moved between the retaining position, the releasing position and the height adjusting position. Securing fulcrum 83 is preferably provided by a threaded screw which is manually adjustable to increase of decrease the transverse loading.

Leg portion 76 of torsion spring 72 is loosely retained in a spring receiving slot 84 (FIGS. 3, 4 and 5A) which extends adjacent to and longitudinally along channel 50. Spring slot 84, therefore, permits leg portion 76 to rotate and laterally displace about securing fulcrum 83, which also extends into slot 84, without interfering with the telescopic raising or lowering of armrest post 33 relative channel 50.

Figure 5B:
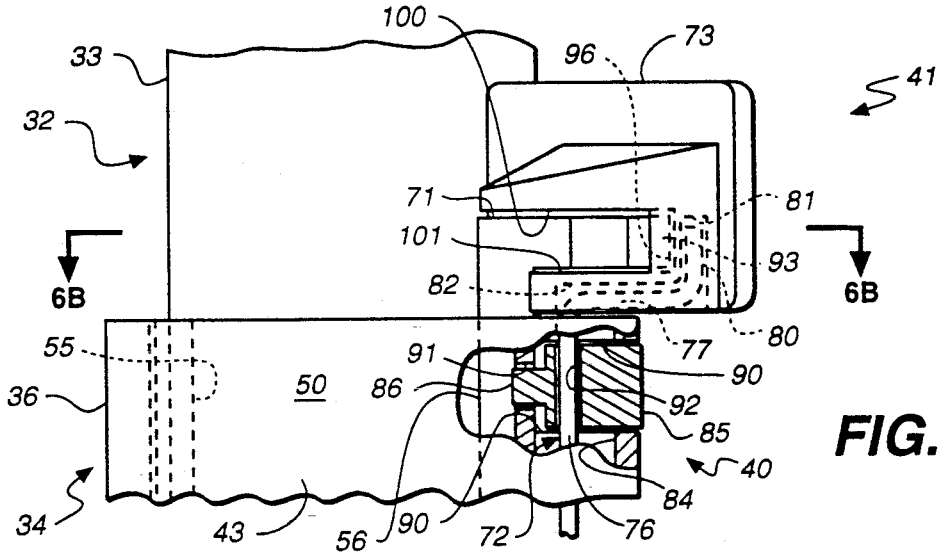
Figure 5C:
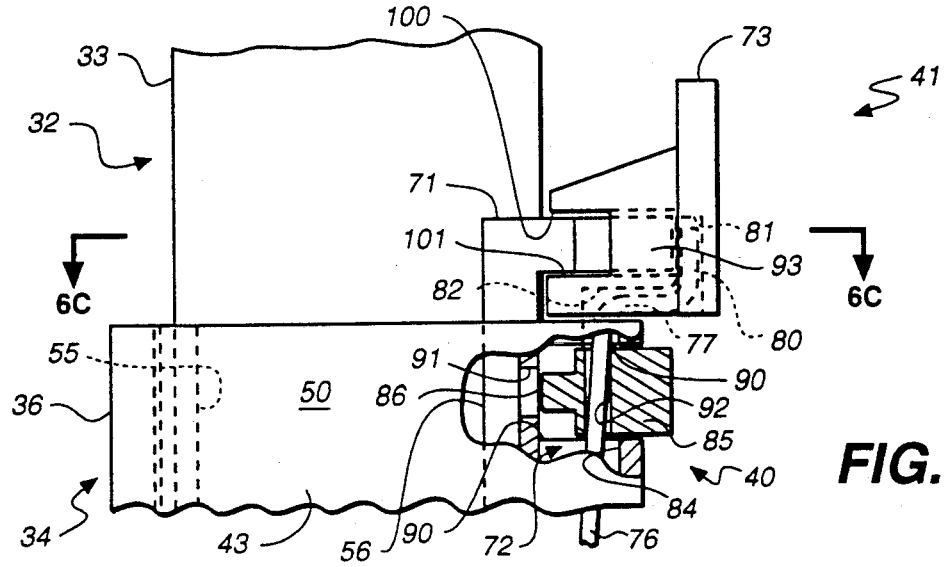
Figure 6A:
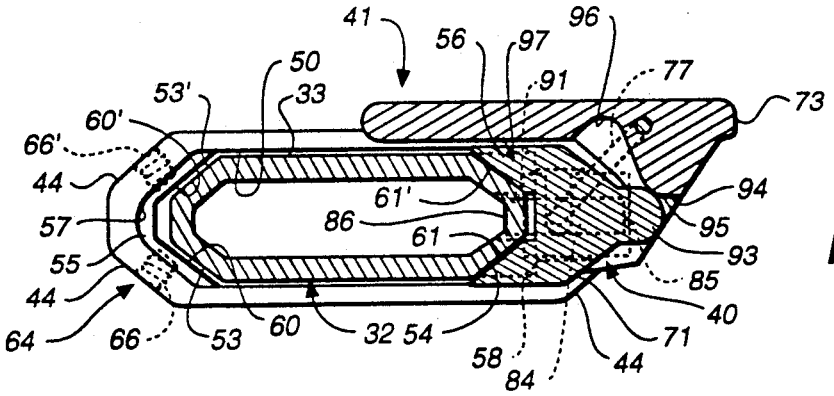
FIGS. 6A-6C are a series of fragmentary top plan views, partially broken away, of the three positions of the latch assembly taken substantially along the plane 6—6 in the corresponding FIGS. 5A-5C.
Figure 6B:
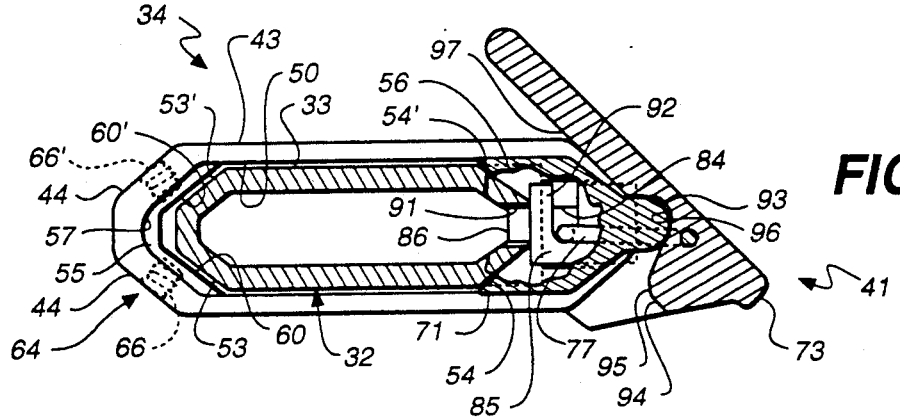
Figure 6C:
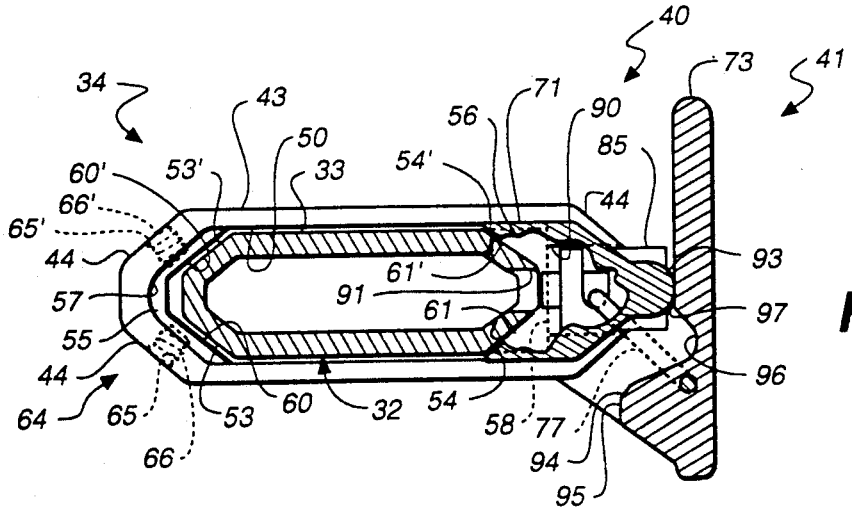

Securing means 40 is positioned between the latch engaging end of torsion spring 72 and securing fulcrum 83, and is slidably coupled to an upper intermediate portion of leg 76 for communicating movement of the securing means between the secured condition (FIGS. 5A, 5B, 6A and 6B) and the unsecured condition (FIGS. 5C and 6C). In the preferred form, securing means 40 is provided by a cylindrical securing pin 85 (FIG. 4) having an engaging nipple 86 on an end thereof. Securing pin 85 is slidably received in a pin receiving bore 90 extending horizontally through armrest engaging end 36 into receiving channel 50. Bore 90 is formed and dimensioned to reciprocally receive pin 85 for sliding movement of the pin between the secured condition and the unsecured condition. In the secured condition, as shown in FIG. 5A, torsion spring 72 extends or moves nipple 86, and hence securing pin 85, into locking engagement with one of a plurality of receiving recesses 91 which are longitudinally positioned along armrest post 33 in a spaced-apart manner between the second armrest chamfers 54, 54'. Recesses 91, which permit armrest support assembly 32 to be retained at a predetermined height relative mounting assembly 34, are formed and dimensioned to receive nipple 86 for locking engagement therebetween. In the unsecured condition, as shown in FIG. 5C, torsion spring 72 retracts or moves nipple 86 out of locking engagement with receiving recess 91 so that armrest support assembly 32 may be telescopically raised or lowered relative mounting assembly 34.

As best illustrated in FIGS. 4 and 5A, securing pin 85 is provided with a pin groove 92 which is formed and dimensioned to transversely and slidably receive a portion of leg 76 between securing fulcrum 83 and the latch engaging end of torsion spring 72. Accordingly, when lever member 73 cooperates with lever engaging member 71, as will be described henceforth, latch engaging end 75 is cantilevered about securing fulcrum 83 in a manner providing lateral movement in spring slot 84 toward and away from receiving channel 50. In turn, leg portion 76 urges securing pin 85, via pin groove 92, to the secured condition (i.e., toward channel 50 in FIGS. 5A and 5B) or to the unsecured condition (i.e., away from channel 50 in FIG. 5C).

Referring now to FIGS. 6A–6C, lever engaging member 71 includes a nose portion 93 extending outwardly toward lever member 73 which slidably contacts a nose cam surface 94 formed on the lever member. The cam surface provides discrete sections which cooperate with the nose portion of engaging member 71 to maintain the lever member in a stable interengaged condition with the lever engaging member at a selected one of: the retaining position (FIGS. 5A and 6A); the mounting assembly releasing position (FIGS. 5B and 6B); and the armrest height adjusting position (FIGS. 5C and 6C).

As best viewed in FIG. 6A, when lever member 73 is manually moved to the retaining position, securing fulcrum 83 urges the lever member into resilient contact with lever engaging member 71 where nose portion 93 is in stable interengagement with a first retaining wall portion 95 of nose cam surface 94. Because of the relative placement of the first retaining wall, the latch engaging end of torsion spring 72 and securing fulcrum 83 cooperate to permit leg portion 76 to be laterally displaced about the securing fulcrum toward the receiving channel. Therefore, as shown in FIG. 5A, securing pin 85 is slidably moved to the secured condition where armrest support assembly 32 is locked relative to mounting assembly 34. Moreover, as will be described below, torsion spring 72 simultaneously urges locking means 37 to the locked condition (FIG. 7A) where the mounting assembly is also locked relative to base member 31.

When lever member 73 is manually moved toward the mounting assembly releasing position (FIGS. 5B and 6B), nose portion 93 slides relatively along nose cam surface 94 until received and releasably retained in stable interengagement with a nose receiving recess portion 96 of nose cam surface 94. In comparing FIGS. 5A with 5B, and 6A with 6B, it may be viewed that although lever member 73 has rotated the leg portion of torsion spring 72 about its longitudinal axis, via latch engaging end 75, the leg portion has not been substantially laterally displaced about securing fulcrum 83. Therefore, securing pin 85 will be retained in the secured condition. In contrast, as will be described below, torsion spring 72 simultaneously urges locking means 37 to the unlocked condition (FIG. 7B) so that the mounting assembly and the support assembly may be removed from base member 31 as a unit.

Lastly, when lever member 73 is manually moved to the armrest height-adjusting position, nose portion 93 of engaging member 71 is manually urged out of stable interengagement with the nose receiving recess of nose cam surface 94 and moved toward a second retaining wall portion 97 (FIGS. 6C). As nose portion 93 slidably engages cam surface 94 during movement of lever member 73 toward the height-adjusting position, latch engaging end 75 rotates leg portion 76 about its longitudinal axis, and further, laterally displaces the leg portion about securing fulcrum 83 in a direction away from channel 50. Accordingly, as viewed in FIGS. 5C and 6C, securing pin 85 is urged to the unsecured condition which withdraws nipple 86 from engagement with receiving recess 91. Armrest post 33 is then free to slidably and telescopically move relative mounting post 43. Again, as will be described below, torsion spring 72 simultaneously urges locking means 37 back to the locked condition (FIG. 7C).

To further retain lever member 73 and lever engaging member 71 in continuous and resilient contact therebetween, the lever member includes a ceiling portion 100 and floor portion 101 positioned above and below, respectively, the nose cam surface 94 (FIGS. 5A–5C). It will be understood that the ceiling and the floor help maintain alignment and stable interengagement between the nose portion and the nose cam surfaces in the various latch positions.

Torsion spring 72 includes a cam engaging end 74 (FIG. 3), opposite the latch engaging end 75, which is formed to slidably engage a spring cam surface 102 in a manner causing locking means 37 to move between the locked condition (FIGS. 7A and 7C) and the unlocked condition (FIG. 7B). To maintain cam engaging end 74 in continuous and resilient slidable engagement with spring cam surface 102, mounting assembly 34 includes a locking fulcrum 103 which extends into spring slot 84 and contacts a lower intermediate portion of leg 76 of torsion spring 72 between opposed ends thereof. Similar to securing fulcrum 83, locking fulcrum 103 transversely loads the resilient leg portion which causes cam engaging end 74 to continuously and resiliently contact spring cam surface 102. Accordingly, the lower leg portion 76 can be laterally displaced or cantilevered about locking fulcrum 103, as well as rotatably displaced, when lever member 73 is manually moved between the retaining position, the releasing position and the height adjusting position. Locking fulcrum 103 is preferably provided by a threaded screw which is manually adjustable to increase of decrease the transverse loading.

It will be appreciated that although locking fulcrum 103 is preferably positioned separate and spaced-apart (i.e., below) from securing fulcrum 83, it is conceivable that a single fulcrum may replace and perform the function of both securing fulcrum 83 and locking fulcrum 103 without departing from the true spirit and nature of the present invention.

Locking means 37 is positioned between cam engaging end 74 of torsion spring 72 and locking fulcrum 103, and is slidably coupled to a lower intermediate portion of leg 76 for communicating movement of the locking means between the locked condition (FIGS. 7A and 7C) and the unlocked condition (FIG. 7B). In the preferred form, locking means 37 is provided by a locking rod 104 aligned and oriented to reciprocate between the locked condition and the unlocked condition in directions between first post surface 53 (first chamfers) and second post surface 54 (second chamfers) of post mounting end 35 . Locking rod 104 is slidably received in a pair of axially aligned rod receiving bores 105, 105' extending horizontally through the first and second post surfaces, respectively, into receiving channel 50. In the locked condition, as shown in FIGS. 7A and 7C, torsion spring 72 extends or moves one end of locking rod 104 into locking engagement with a rod receiving recess 106 provided in base member 31 which is formed and dimensioned to slidably receive the one end of the locking rod for engagement therebetween. In the unlocked condition, as shown in FIG. 7B, torsion spring 72 retracts or moves the one end of locking rod 104 out of locking engagement with receiving recess 106 so that mounting assembly 34 may be separated or removed from base member 31.

It will be understood that the mounting end of mounting post 43 must be properly received in receiving cavity 42 where receiving recess 106 is coaxially aligned with locking rod 104 in order for locking means 37 to move to the locked condition. As previously mentioned, once the mounting end is inserted into the receiving cavity, stopping lip 47 limits the penetration of the mounting end into the receiving cavity, and further, coaxially aligns the components of locking means 37.

Similar to securing pin 85 and as viewed in FIGS. 7A–7C, locking rod 104 is provided with a rod groove 107 which is formed and dimensioned to transversely and slidably receive a lower intermediate portion of leg 76 between locking fulcrum 103 and the cam engaging end of torsion spring 72. Accordingly, when cam engaging end 74 cooperates with spring cam surface 102, as will be described henceforth, cam engaging end 74 is cantilevered about locking fulcrum 103 in a manner providing lateral movement in spring slot 84 toward and away from receiving channel 50. In turn, leg portion 76 urges locking rod 104, via rod groove 107, to the locked condition (i.e., toward channel 50 in FIGS. 7A and 7C) or to the unlocked condition (i.e., away from channel 50 in FIG. 7B).

Cam engaging end 74, as shown in FIGS. 3 and 7A–7C, is provided by a hook-shaped portion torsionally mounted to the bottom distal end of spring leg portion 76. Extending outward from the leg portion is an elbow portion 108 formed to slidably contact spring cam surface 102. The cam surface is substantially V-shaped and includes a first spring engaging surface 109 and a second spring engaging surface 110 angularly inclined to the first engaging surface. These two inclined engaging surfaces intersect along a common substantially vertical apex edge 111 which faces toward the cam engaging end of torsion spring 72.

As latch assembly 41 is manually moved between latch positions (i.e., the retaining position, the releasing position and the height adjusting position), lever member 73 applies torsional forces to torsion spring 72 which reciprocate cam engaging end 74 between first engaging surface 109 and second engaging surface 110. Accordingly, when lever member 73 is manually moved to the retaining position (i.e., nose portion 93 of lever engaging member 71 is in stable interengagement with first retaining wall 95 of nose cam surface 94 (FIG. 6A)), cam engaging end 74 is positioned in a manner where elbow 108 engages first engaging surface 109 away from apex edge 111. The cam engaging end of torsion spring 72 and locking fulcrum 103 cooperate to permit leg portion 76 to be laterally displaced about the locking fulcrum toward receiving channel 50. Therefore, as shown in FIG. 7A, locking rod 104 is slidably moved, via rod groove 107, to the locked condition where mounting assembly 32 is locked relative to base member 34. As above-described, torsion spring 72 simultaneously urges securing means 40 to the secured condition (FIG. 5A and 6A) where the armrest support assembly is also locked relative to the mounting assembly.

When lever member 73 is manually moved toward the mounting assembly releasing position (i.e., where nose portion 93 is releasably retained in stable interengagement with a nose receiving recess portion 96 of nose cam surface 94 (FIG. 6B)), the torsional force applied by lever member 73 on torsion spring 72 causes the leg portion to rotate about its longitudinal axis. As shown in FIG. 7B, once lever member 73 is stably interengaged in the releasing position, elbow portion 108 is stably retained against one of first engaging surface 109 and second engaging surface 110 proximate apex edge 111. In the preferred embodiment, elbow portion 108 is moved over apex edge 111 and retained against the second surface. This orientation causes leg portion 76 to laterally displace about locking fulcrum 103 in a direction away from channel 50. In turn, leg portion 76, via rod groove 107, slidably moves locking rod 104 out of locking engagement with rod receiving recess 106 and to the unlocked condition. Accordingly, mounting assembly 34 is then free to slidably be removed from receiving cavity 42 of the base member. Torsion spring 72, in contrast, simultaneously retains securing means 40 in the secured condition (FIGS. 5B and 6B).

Finally, when lever member 73 is manually moved to the armrest height-adjusting position, (i.e., where nose portion 93 is releasably retained in stable interengagement with second retaining wall portion 97 of nose cam surface 94 (FIGS. 6C)), the torsional force applied by lever member 73 on torsion spring 72 causes the leg portion to further rotate about its longitudinal axis. FIG. 7C illustrates that, elbow 108 further slidably engages second engaging surface 110 in a direction away from apex edge 111. In this position, leg portion 76 laterally displaces about locking fulcrum 103 in a direction toward channel 50 which causes locking rod 104 to slidably move back into locking engagement with rod receiving recess 106 toward the locked condition. Again, as above-mentioned, torsion spring 72 simultaneously urges securing means 40 to the secured condition (FIGS. 5C and 6C) where the armrest support assembly is free to be raised or lowered relative to the mounting assembly.

In another aspect of the present invention, modular bracket means 112 are provided upon which a plurality of modular units 113 can be releasably mounted to mounting assembly 34. As best viewed in FIGS. 2 and 3, modular bracket means 112 is provided by a pair of spaced-apart sleeve members 114 and 114' formed and dimensioned to slidably couple to the periphery of mounting post 43. Preferably, sleeve members 114,114' can slidably move longitudinally along the mounting post to adjust the height or separation distance between the sleeve members. Fasteners 115 (FIG. 2) releasably lock the sleeves to the mounting post.

Sleeve members 114, 114' include cylindrical stub portions 116, 116' (FIG. 3) extending outwardly from mounting assembly 34 upon which a single modular unit 113 can be removably mounted. Accordingly, the modular unit includes stub receptacles 117, 117' formed to slidably receive respective stub portions 116, 116' for snug and stable mating engagement therebetween. A fastener (not shown) can releasably lock the receptacle to the stub portions.

In one embodiment, modular unit 113 include a U-shaped support rail 118, as shown in FIG. 2. In an alternative embodiment, modular unit 113 may include a tray portion extending laterally across the wheelchair occupants lap so that items may be supported on the tray.

What is claimed is:

1. A height-adjustable, removable armrest apparatus for a wheelchair having wheelchair frame means, said armrest apparatus comprising:

a base member formed for mounting to said wheelchair frame means;

an arm support assembly including a height-adjustable armrest post;

an elongated mounting assembly having a mounting end and an opposite armrest post engaging end;

a locking mechanism movably mounted to one of said mounting end of said mounting assembly and said base member for locking engagement with the other of said base member and said assembly mounting end, respectively, said locking mechanism being movable between a locked condition, locking said mounting end to said base member, and a unlocked condition, releasing said mounting end from said base member;

a securing mechanism movably mounted to one of said armrest post and said engaging end of said mounting assembly for locking engagement with the other of said assembly engaging end and armrest post, respectively, said securing mechanism being movable between a secured condition, locking said armrest post to said mounting assembly, and an unsecured condition, permitting height adjusting movement of said armrest post relative to said engaging end; and a manually engageable single latch assembly co-operably coupled to both said locking mechanism and said securing mechanism, and formed for simultaneous cooperating movement, between said locking mechanism and said securing mechanism, of a selected one of:

(i) the locking mechanism from said locked condition to said unlocked condition, while said securing mechanism is retained in said secured condition, and (ii) the securing mechanism from said secured condition to said unsecured condition, while said locking mechanism is retained in said locked condition.

2. A height-adjustable, removable armrest apparatus as defined in claim 1 wherein, said latch assembly includes a spring operably engageable with both said locking mechanism and said securing mechanism, said latch assembly being manually movable between a selected one of:

(i) a retaining position wherein said spring urges said locking mechanism toward said locked condition and said securing mechanism toward said secured condition, (ii) a mounting assembly releasing position wherein said spring urges said locking mechanism toward said unlocked condition and said securing mechanism toward said secured condition, and (iii) an armrest height adjusting position wherein said spring urges said locking mechanism toward said locked condition and said securing mechanism toward said unsecured condition.

3. A height-adjustable, removable armrest apparatus as defined in claim 2 wherein, said spring is provided by an elongated torsion spring extending longitudinally along said mounting assembly and communicating movement to said locking mechanism and said securing mechanism by rotation about a longitudinal axis thereof.

4. A height-adjustable, removable armrest apparatus as defined in claim 3 wherein, said mounting assembly includes a locking fulcrum positioned to contact said torsion spring intermediate opposed ends of said torsion spring to transversely load said torsion spring into contact with a spring cam surface proximate said mounting end of said mounting assembly.

5. A height-adjustable, removable armrest apparatus as defined in claim 4 wherein, said torsion spring is metallic and formed with a cam engaging end formed to engage said spring cam surface in a manner causing said locking mechanism to move between said locked condition and said unlocked condition.

6. A height-adjustable, removable armrest apparatus as defined in claim 5 wherein, said spring cam surface is defined by a first spring engaging surface and a second spring engaging surface angularly inclined to said first engaging surface, said first engaging surface and said second engaging surface intersecting along a common apex edge which faces toward said torsion spring.

7. A height-adjustable, removable armrest apparatus as defined in claim 6 wherein, said torsion spring, said locking fulcrum and said latch assembly cooperate in a manner such that:

(i) said cam engaging end engages said first engaging surface away from said apex edge when said latch assembly is moved toward said retaining position, (ii) said cam engaging end engages one of said first engaging surface and said second engaging surface proximate said apex edge when said latch assembly is moved toward said mounting assembly releasing position, and (iii) said cam engaging end engages said second engaging surface away from said apex edge when said latch assembly is moved toward said height-adjusting position.

8. A height-adjustable, removable armrest apparatus as defined in claim 7 wherein, said cam engaging end of said torsion spring is provided by a hook-shaped portion having an engaging tip which slidably engages said spring cam surface.

9. A height-adjustable, removable armrest apparatus as defined in claim 8 wherein, said first engaging surface and said second engaging surface are substantially vertically planar walls.

10. A height-adjustable, removable armrest apparatus as defined in claim 6 wherein, said spring cam surface is provided by a cap member removably mounted to a distal end of said mounting end of said mounting assembly.

11. A height-adjustable, removable armrest apparatus as defined in claim 3 wherein, said mounting assembly includes a securing fulcrum positioned to contact said torsion spring intermediate opposed ends of said torsion spring to transversely load said torsion spring into contact with said latch assembly.

12. A height-adjustable, removable armrest apparatus as defined in claim 11 wherein, said latch assembly includes a lever member mounted to an end of said torsion spring, and a lever engaging member positioned proximate said post engaging end of said mounting assembly, said lever engaging member having a nose portion formed to engage said lever member in a manner holding said lever member in a stable interengaged condition with said lever engaging member when said securing mechanism is in both said secured condition and said unsecured condition.

13. A height-adjustable, removable armrest apparatus as defined in claim 12 wherein, said torsion spring and said securing fulcrum cooperate to urge a nose cam surface found in said lever member against said nose portion of said lever engaging member.

14. A height-adjustable, removable armrest apparatus as defined in claim 13 wherein, said nose cam surface includes a nose receiving recess formed to manually and slidably receive and releasably retain said nose portion when said latch assembly is moved toward said mounting assembly releasing position, and said nose cam surface includes a nose engaging portion adjacent said nose receiving recess formed to manually and slidably engage and releasably retain said nose portion when said latch assembly is moved toward said height-adjusting position.

15. A height-adjustable, removable armrest apparatus as defined in claim 2 wherein, said base member is formed with a mounting cavity formed and dimensioned for sliding receipt of said mounting end of said mounting assembly.

16. A height-adjustable, removable armrest apparatus as defined in claim 15 wherein, said locking mechanism includes a locking rod slidably mounted to said mounting end of said mounting assembly for movement between said locked condition and said unlocked condition, and said base member further having a rod receiving recess positioned proximate said cavity, and formed and dimensioned to receive said locking rod when said locking mechanism is moved to said locked condition, said locking rod being free of engagement with said rod receiving recess when said locking mechanism is moved to said unlocked position.

17. A height-adjustable, removable armrest apparatus as defined in claim 16 wherein, said spring is provided by a torsion spring extending longitudinally along said mounting assembly.

18. A height-adjustable, removable armrest apparatus as defined in claim 17 wherein, said mounting assembly includes a locking fulcrum and a securing fulcrum positioned longitudinally in said mounting assembly to contact said torsion spring at spaced apart locations intermediate opposed ends of said torsion spring to transversely load said torsion spring.

19. A height-adjustable, removable armrest apparatus as defined in claim 18 wherein, said torsion spring includes a cam engaging end and an opposite latch engaging end, said cam engaging end being mounted to engage a spring cam surface in said mounting end of said mounting assembly in a manner causing said locking rod to move between said locked condition and said unlocked condition, and said latch engaging end being coupled to a manually engageable latching lever for application of torsion forces to said torsion spring.

20. A height-adjustable, removable armrest apparatus as defined in claim 19 wherein, said locking rod is formed with a rod groove transversely receiving a portion of said torsion spring between said locking fulcrum and said cam engaging end.

21. A height-adjustable, removable armrest apparatus as defined in claim 20 wherein, said spring cam surface is defined by a first spring engaging surface and a second spring engaging surface angularly inclined to said first engaging surface, said first engaging surface and said second engaging surface intersecting along a common apex edge which faces toward said torsion spring.

22. A height-adjustable, removable armrest apparatus as defined in claim 21 wherein, said torsion spring, said locking fulcrum and said latch assembly cooperate in a manner such that:

(i) said cam engaging end engages said first engaging surface away from said apex edge when said latching lever of said latch assembly is moved to said retaining position, (ii) said cam engaging end engages one of said first engaging surface and said second engaging surface proximate said apex edge when said latching lever is moved to said mounting assembly releasing position, and (iii) said cam engaging end engages said second engaging surface away from said apex edge when said latching lever is moved to said height-adjusting position.

23. A height-adjustable, removable armrest apparatus as defined in claim 22 wherein, said spring cam surface is provided by a cap member removably mounted to the distal end of said mounting end of said mounting assembly.

24. A height-adjustable, removable armrest apparatus as defined in claim 2 wherein, said mounting assembly defines an armrest receiving channel extending longitudinally therethrough, and formed and dimensioned for telescopic sliding receipt of a distal end of said armrest post.

25. A height-adjustable, removable armrest apparatus as defined in claim 24 wherein, said securing mechanism includes a securing pin slidably mounted to said engaging end of said mounting assembly for movement between said secured condition and said unsecured condition, and said armrest post is formed with a plurality of pin receiving recesses extending longitudinally along said armrest post, each said pin recess being formed and dimensioned to receive and engage said securing pin when said securing mechanism is moved to said secured condition, said securing pin being free of engagement with said pin receiving recesses when said securing mechanism is moved to said unsecured position.

26. A height-adjustable, removable armrest apparatus as defined in claim 25 wherein, said spring is provided by a torsion spring extending longitudinally along said receiving channel.

27. A height-adjustable, removable armrest apparatus as defined in claim 26 wherein, said torsion spring resiliently bends about a securing fulcrum member carried by said mounting assembly and extending into said receiving channel and contacting an intermediate portion of said torsion spring to transversely load said torsion spring into contact with said latch assembly.

28. A height-adjustable, removable armrest apparatus as defined in claim 27 wherein, said latch assembly includes a lever member mounted to an end of said torsion spring, and a lever engaging member positioned proximate said post engaging end of said mounting assembly, said lever engaging member having a nose portion formed to engage said lever member to hold said lever member in a stable interengagement with said lever engaging member in both said secured condition and said unsecured condition.

29. A height-adjustable, removable armrest apparatus as defined in claim 28 wherein, said torsion spring and said securing fulcrum member cooperate to urge a nose cam surface of said lever member against said nose portion of said lever engaging member.

30. A height-adjustable, removable armrest apparatus as defined in claim 29 wherein, said securing pin is formed with a pin groove transversely receiving a portion of said torsion spring between said securing fulcrum member and said lever member.

31. A height-adjustable, removable armrest apparatus as defined in claim 30 wherein, said mounting assembly includes a spring receiving slot extending longitudinally therealong proximate said channel and formed to receive said torsion spring therein.

32. A height-adjustable, removable armrest apparatus as defined in claim 31 wherein, said securing fulcrum member extends into said spring receiving slot.

33. A height-adjustable, removable armrest apparatus as defined in claim 1 wherein, said armrest post includes a first post surface extending longitudinally along one side thereof, and said mounting assembly includes a longitudinally extending channel dimensioned to loosely receive said post therein, a first channel lining positioned in said channel and aligned in an orientation to resiliently and slidably contact said first post surface when said armrest post is received in said channel, and lining adjustment means urging said first channel lining toward said first post surface to produce snug sliding engagement of said first post surface with said first channel lining.

34. A height-adjustable, removable armrest apparatus as defined in claim 33 wherein, said lining adjustment means is provided by an adjustable screw abutting a backside of said first channel lining.

35. A height-adjustable, removable armrest apparatus as defined in claim 33 wherein, said first channel lining includes a middle finger portion and two outer finger portions each being disposed on opposite sides of said middle finger, each finger portion extending downwardly from a bottom of said first channel lining, and said line adjustment means includes a resilient liner plate spring having finger engaging portions formed to engage a backside of each outer finger portion in a manner urging each outer finger portion toward said first post surface to produce snug sliding engagement of said first post surface with each outer finger portion.

36. A height-adjustable, removable armrest apparatus as defined in claim 35 wherein, said lining adjustment means further includes an adjustable screw abutting a backside of said finger engaging portion of said liner plate spring.

37. A height-adjustable, removable armrest apparatus as defined in claim 33 wherein, said armrest post includes a second post surface extending longitudinally along an opposite side thereof, and said mounting assembly includes a second channel lining positioned in said channel and aligned in an orientation slidably contacting said second post surface for engagement therebetween when said armrest post is received in said channel.

38. A height-adjustable, removable armrest apparatus as defined in claim 37 wherein, said second channel lining is formed at an upper end with said lever engaging member.

39. A height-adjustable, removable armrest apparatus for a wheelchair having wheelchair frame means, said armrest apparatus comprising:

a base member formed for mounting to said wheelchair frame means;

an arm support assembly including a height-adjustable armrest post;

an elongated mounting assembly having a mounting end and an opposite armrest post engaging end;

a locking mechanism movably mounted to one of said mounting end of said mounting assembly and said base member for locking engagement with the other of said base member and said assembly mounting end, respectively, said locking mechanism being movable between a locked condition, locking said mounting end to said base member, and a unlocked condition, releasing said mounting end from said base member;

a securing mechanism movably mounted to one of said armrest post and said engaging end of said mounting assembly for locking engagement with the other of said assembly engaging end and armrest post, respectively, said securing mechanism being movable between a secured condition, locking said armrest post to said mounting assembly, and an unsecured condition, permitting height adjusting movement of said armrest post relative to said engaging end; and a manually engageable latch assembly operably coupled to both said locking mechanism and said securing mechanism for simultaneous cooperating movement between said locking mechanism and said securing mechanism, said latch assembly being movable between a selected one of:

(i) a retaining position where said locking mechanism is moved toward said locking condition and said securing mechanism is moved toward said secured condition, (ii) a mounting post releasing position where said locking mechanism is moved toward said unlocked condition and said securing mechanism is moved toward said secured condition, and (iii) an armrest height adjusting position where said locking mechanism is moved toward said locked condition and said securing mechanism is moved toward said unsecured condition.

40. A height-adjustable, removable armrest apparatus as defined in claim 39 further including:

a spring operably engageable with both said locking mechanism and said securing mechanism to enable movement of said locking mechanism between said locked condition and said unlocked condition, and to enable movement of said securing mechanism between said secured condition and said unsecured condition.

41. A height-adjustable, removable armrest apparatus as defined in claim 40 wherein, said base member is formed with a mounting cavity formed and dimensioned for sliding receipt of said mounting end of said mounting assembly.

42. A height-adjustable, removable armrest apparatus as defined in claim 41 wherein, said armrest post includes a post surface extending longitudinally along one side thereof, and said mounting assembly includes a longitudinally extending receiving channel dimensioned to loosely receive said post therein, a channel lining positioned in said channel and aligned in an orientation to resiliently and slidably contact said post surface when said armrest post is received in said channel, and lining adjustment means urging said channel lining toward said post surface to produce snug sliding engagement of said post surface with said first channel lining.

43. A height-adjustable, removable armrest apparatus as defined in claim 42 wherein, said spring is provided by a torsion spring extending longitudinally along said receiving channel.

44. A height-adjustable, removable armrest apparatus as defined in claim 43 wherein, said mounting assembly includes a locking fulcrum and a securing fulcrum positioned longitudinally in said mounting assembly to contact said torsion spring at spaced apart locations intermediate opposed ends of said torsion spring to transversely load said torsion spring.

45. A height-adjustable, removable armrest apparatus as defined in claim 44 wherein, said lining adjustment means is provided by an adjustable screw abutting a backside of said first channel lining.

46. A height-adjustable, removable armrest apparatus as defined in claim 39 further including:

modular bracket means removably and slidably coupled to said mounting assembly for mounting of a modular unit thereto.

47. A height-adjustable, removable armrest apparatus as defined in claim 46 wherein, said bracket means includes a stub portion extending outwardly from said mounting assembly, said modular unit being removably mounted to said stub portion.

48. A height-adjustable, removable armrest apparatus as defined in claim 47 wherein, said modular unit is a support handle.

49. A height-adjustable, removable armrest apparatus as defined in claim 47 wherein, said modular unit includes a support tray.

* * * * *